US010039395B2

(12) United States Patent
Holmes

(10) Patent No.: US 10,039,395 B2
(45) Date of Patent: Aug. 7, 2018

(54) NURSING AID AND CHILD PROTECTION SYSTEM

(71) Applicant: Larry Holmes, Fishers, IN (US)

(72) Inventor: Larry Holmes, Fishers, IN (US)

( * ) Notice: Subject to any disclaimer, the term of this patent is extended or adjusted under 35 U.S.C. 154(b) by 443 days.

(21) Appl. No.: 14/943,837

(22) Filed: Nov. 17, 2015

(65) Prior Publication Data

US 2017/0135506 A1 May 18, 2017

(51) Int. Cl.
*A47G 9/10* (2006.01)
*A47D 13/08* (2006.01)

(52) U.S. Cl.
CPC ..... *A47G 9/1009* (2013.01); *A47D 13/083* (2013.01); *A47G 9/10* (2013.01)

(58) Field of Classification Search
CPC .... A47D 13/08; A47D 13/083; A47D 15/003; A47D 15/005; A47D 15/008; A47G 9/1009; A47G 9/1072; A47B 23/00
See application file for complete search history.

(56) References Cited

U.S. PATENT DOCUMENTS 3,137,870 A * 6/1964 Fink ..... A47D 15/008 5/246
3,402,409 A * 9/1968 Kain ..... A47C 21/08 5/426
4,483,028 A * 11/1984 Payne ..... A47D 15/008 16/266
4,733,836 A * 3/1988 Barnes ..... A47D 13/08 248/106
5,261,134 A 11/1993 Matthews
5,491,851 A * 2/1996 Alonso ..... A47C 27/001 5/420
5,581,832 A * 12/1996 Bridley ..... A47D 13/08 5/655
5,661,861 A 9/1997 Matthews
6,038,720 A 3/2000 Matthews et al.
6,055,687 A 5/2000 Matthews
6,272,704 B1 * 8/2001 Cutler ..... A47D 5/006 5/420
6,279,185 B1 8/2001 Matthews
6,412,128 B1 7/2002 Matthews
6,434,770 B2 8/2002 Matthews Brown
6,453,493 B1 9/2002 Matthews Brown
6,532,612 B2 3/2003 Matthews Brown
6,625,828 B2 9/2003 Matthews Brown
6,658,681 B2 * 12/2003 Britto ..... A47D 13/083 5/636
6,671,908 B2 1/2004 Brown et al.
6,685,024 B1 2/2004 Matthews
6,763,539 B1 7/2004 Bartley et al.
(Continued)

*Primary Examiner* — Eric J Kurilla
(74) *Attorney, Agent, or Firm* — Steven F. Owens; Merchant & Gould

(57) ABSTRACT

The nursing aid and child protection system provides a cushioned support to aid in feeding a child. The nursing aid and child protection system includes inner frames to provide rigid support and a cushion on the inner frames to provide a comfortable position for the mother and the child. Thus, the nursing aid and child protection system assists feedings at any hour, allowing them a safe, comfortable way to position the mother and the child in a relaxing position and creating a safer environment for the child.

20 Claims, 12 Drawing Sheets

(56) References Cited

U.S. PATENT DOCUMENTS

| | | | | |
|---|---|---|---|---|
| 6,845,534 | B1 * | 1/2005 | Huang | A47C 7/383 297/393 |
| 6,851,143 | B2 | 2/2005 | Matthews Brown | |
| 6,857,150 | B2 | 2/2005 | Matthews Brown et al. | |
| 6,944,898 | B2 | 9/2005 | Matthews Brown et al. | |
| 7,000,274 | B2 | 2/2006 | Matthews Brown et al. | |
| 7,055,196 | B2 | 6/2006 | Littlehom | |
| 7,146,663 | B2 | 12/2006 | Brown et al. | |
| 7,331,073 | B2 | 2/2008 | Littlehorn et al. | |
| 9,032,570 | B1 * | 5/2015 | Benami | A47G 9/1009 5/640 |
| 9,725,937 | B2 * | 8/2017 | Lange | E05D 3/00 |
| 2006/0075563 | A1 * | 4/2006 | Bartner | A47D 13/083 5/655 |
| 2013/0111673 | A1 * | 5/2013 | Chen | A47C 31/00 5/722 |
| 2013/0125314 | A1 | 5/2013 | Kummerfeld et al. | |
| 2016/0286982 | A1 * | 10/2016 | Smith | A47D 15/008 |

* cited by examiner

NURSING AID AND CHILD PROTECTION SYSTEM

BACKGROUND

Nursing mothers encounter numerous types of problems while feeding a child. One frequent problem encountered by mothers is the inability to find a comfortable position while feeding.

Typically, mothers will feed a child while sitting in a gliding or rocking chair, in order to provide motion to sooth the child. However, while the gliding or rocking chair provides some comfort to the child, the mothers are not provided with any additional comfort for holding the child in the feeding position. The mothers may also use a support pillow to provide additional comfort. The support pillow is typically U-shaped and extends from the woman's side across her front to the woman's other side. The support pillow provides a surface on which to rest the child to provide the mother and the child more comfort during feeding.

Alternatively, the mother may desire to feed the child from a horizontal position. However, the horizontal position still requires the mother to utilize a support pillow. These types of support pillows exist in a variety of shapes and sizes. The most common type of pillow is generally rectangular and is filled with natural or synthetic materials. Such pillows are traditionally designed to support a person's head while lying in bed. Other types of support pillows include the U-shaped support pillow described above and support pillows configured to support a pregnant woman's stomach.

SUMMARY

The nursing aid and child protection system, also referred to as the Nursing AssiTENT, provides a cushioned support to aid in feeding a child. The nursing aid and child protection system includes inner frames to provide rigid support and a cushion on the inner frames to provide a comfortable position for the nursing mother and the child. Thus, the nursing aid and child protection system assists feedings at any hour, allowing a safe, comfortable way to position the mother and the child in a relaxing position and creating a safer environment for the child.

BRIEF DESCRIPTION OF THE DRAWINGS

The accompanying drawings, which are incorporated in and constitute a part of this disclosure, illustrate various aspects of the present disclosure. In the drawings.

DETAILED DESCRIPTION

Figure 1:
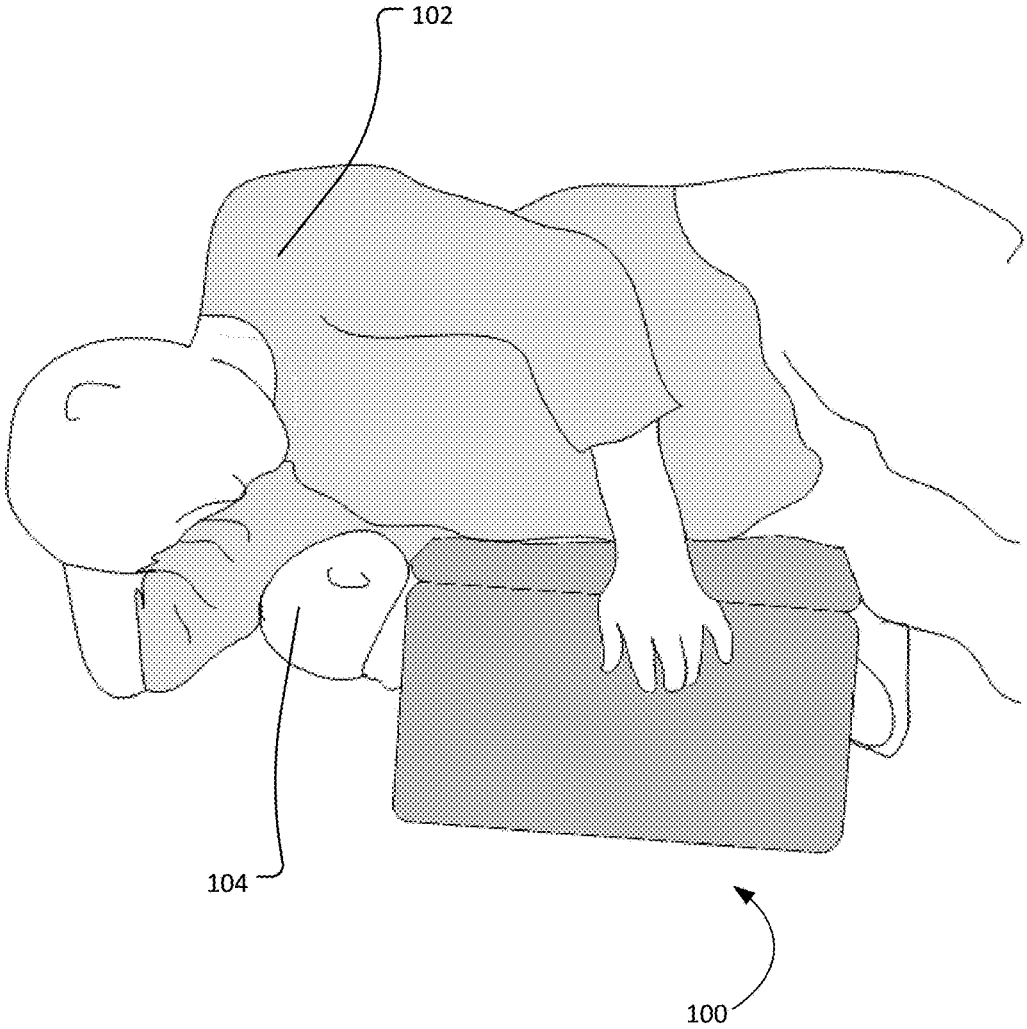
FIG. 1 illustrates a mother and child utilizing an example nursing aid and child protection system.

The following detailed description refers to the accompanying drawings, and wherever possible, the same reference number is used to refer to the same or similar element. Aspects of the present disclosure may be described herein with the understanding that modifications, adaptations, and other implementations are possible. For example, substitutions, additions, or modifications may be made to the elements illustrated in the drawings. Accordingly, the following detailed description does not limit the present disclosure, but rather, the proper scope of the present disclosure is defined by the appended claims. The following detailed description, therefore, is not to be taken in a limiting sense.

The nursing aid and child protection system provides a cushioned support to aid in feeding a child. The nursing aid and child protection system assists feedings at any hour, allowing a safe, comfortable way to position the mother and the child in a relaxing position and creating a safer environment for the child. The term "mother" is used herein to refer to any person feeding a child in accordance with the present disclosure, and is not limited to the biological mother of the child being fed. It will be understood that persons other than the biological mother of the child being fed (e.g., a biological father, an adoptive parent, a grandparent, a wet nurse, an au pair) may make use of the nursing aid and child protection system when feeding the child, although that person may be biologically unable to nurse the child because feeding the child is not limited to breast feeding, and may include bottle or other methods of feeding or soothing the child.

FIG. 1 illustrates a mother 102 and child 104 utilizing an example nursing aid and child protection system 100. The illustrated example shows one manner of using the nursing aid and child protection system 100. As will be discussed further, the nursing aid and child protection system 100 may also provide a variety of other uses.

In the illustrated embodiment, the nursing aid and child protection system 100 provides a cushioned support to aid in feeding a child 104. Specifically, the nursing aid and child protection system 100 is arranged to simultaneously support the mother 102 and to protect the child 104.

In the illustrated embodiment, the nursing aid and child protection system 100 is position over a child 104. For example, the nursing aid and child protection system 100 provides an inner cavity 116 that is configured to contain a child 104 underneath. As illustrated, the child 104 is positioned with his head outside of the nursing aid and child protection system 100 for feeding.

The nursing aid and child protection system 100 is positioned adjacent to the mother 102 while lying on in a horizontal position (e.g., on a bed, on a seat, on the floor). Specifically, the nursing aid and child protection system 100 is positioned at the mother's belly such that the mother's breast is outside of nursing aid and child protection system 100 at the child's head. In the illustrated embodiment, the mother 102 is laying with one arm under her head and one arm being comfortably supported by the nursing aid and child protection system 100.

The nursing aid and child protection system 100 provides additional support to the mother's body, including the upper body, belly area, legs, and the like. Further, the nursing aid and child protection system 100 may conform to the mother's body such that it contacts the mother's upper body, giving the user a sizeable lateral surface on which to place the mother's body.

Further, the nursing aid and child protection system 100 is configured to resist application of direct pressure onto the child 104. For example, after feeding the child 104, the mother 102 may not wish to disturb the child 104. Accordingly, the nursing aid and child protection system 100 may be used to protect the child 104 while co-sleeping with the mother 102. The nursing aid and child protection system 100 prevents the mother 102 from rolling onto the child 104 or otherwise applying undesirable pressure to the child 104.

Further, the nursing aid and child protection system 100 may be utilized when momentarily laying the child 104 down. This may be particularly advantageous to prevent the child 104 from rolling away and accidentally falling and hurting himself. Additionally, the nursing aid and child protection system 100 may also be used to support the child 104 in the sitting position as the child 104 grows. Specifically, the enlarged front 108 and back portion 110 of the nursing aid and child protection system 100 supports the child's back assists in keeping an upright posture.

Figure 2:
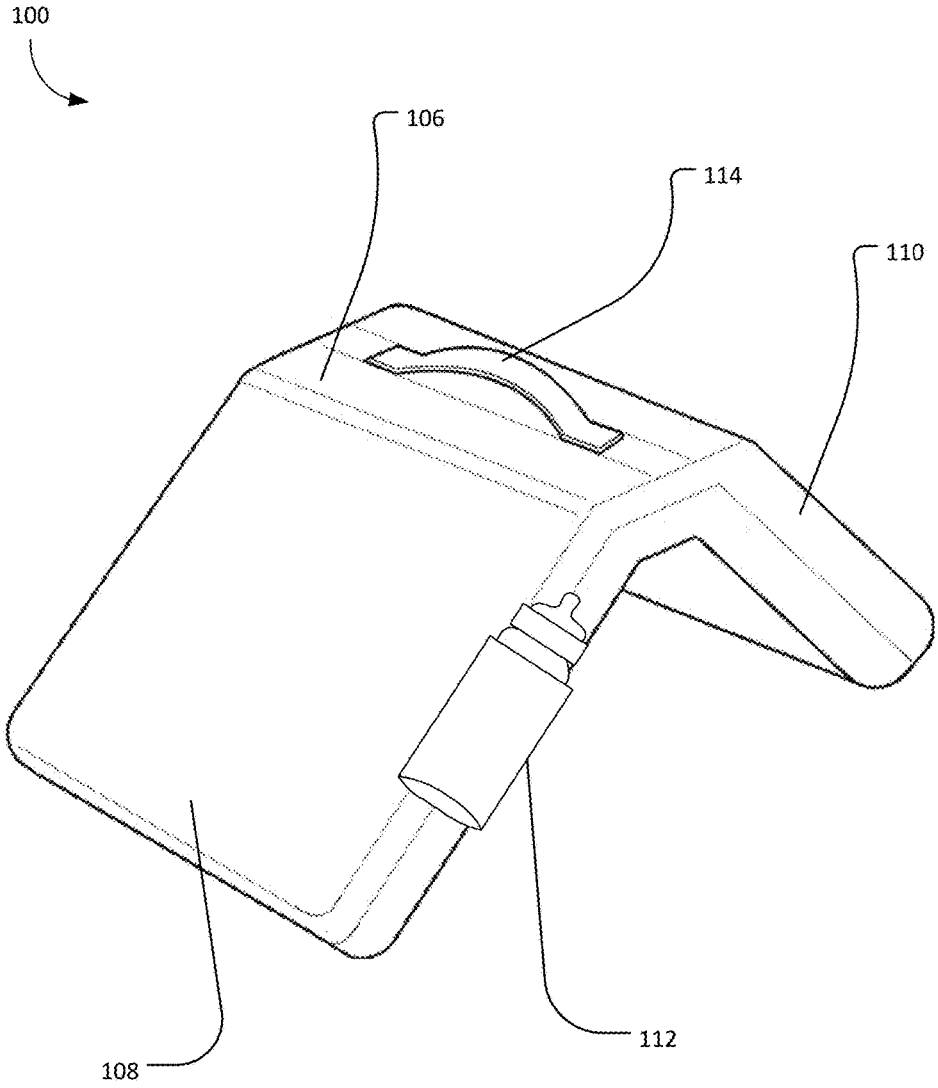
FIG. 2 illustrates an example nursing aid and child protection system.

FIG. 2 illustrates an example nursing aid and child protection system 100. Generally, the nursing aid and child protection system 100 provides a cushioned surface having a top portion 106, a front portion 108, and a rear portion 110. Although illustrated of equal size and shape, in some aspects the front portion 108 and the read portion 110 may be sized or dimensioned unevenly to each other. The nursing aid and child protection system 100 may be arranged with a cushioned surface on each of the top portion 106, a front portion 108, and a rear portion 110. In other embodiments, the nursing aid and child protection system 100 may have one or more cushioned surfaces.

The illustrated nursing aid and child protection system 100 also includes a pocket 112 to hold a bottle. In various aspects, the pocket 112 may be a cupped pocket, open at one end, or a cylindrical sleeve, open at both ends, and may be comprised of an elastic material or may include cinches, drawstrings, or caps to secure variously sized bottles. Although the nursing aid and child protection system 100 may provide particular advantages for breastfeeding, the nursing aid and child protection system 100 may also provide the same or similar advantages for bottle feeding a child.

Further, the illustrated nursing aid and child protection system 100 includes a handle 114 attached to the top portion 106. The handle 114 provides a point of manipulation for a user to carry or reposition the nursing aid and child protection system 100.

It should also be recognized that the handle 114 and bottle holder 112 may be particularly advantageous for allowing a person to carry the child 104 in one arm and carrying the nursing aid and child protection system 100 and bottle with the other.

Figure 3:
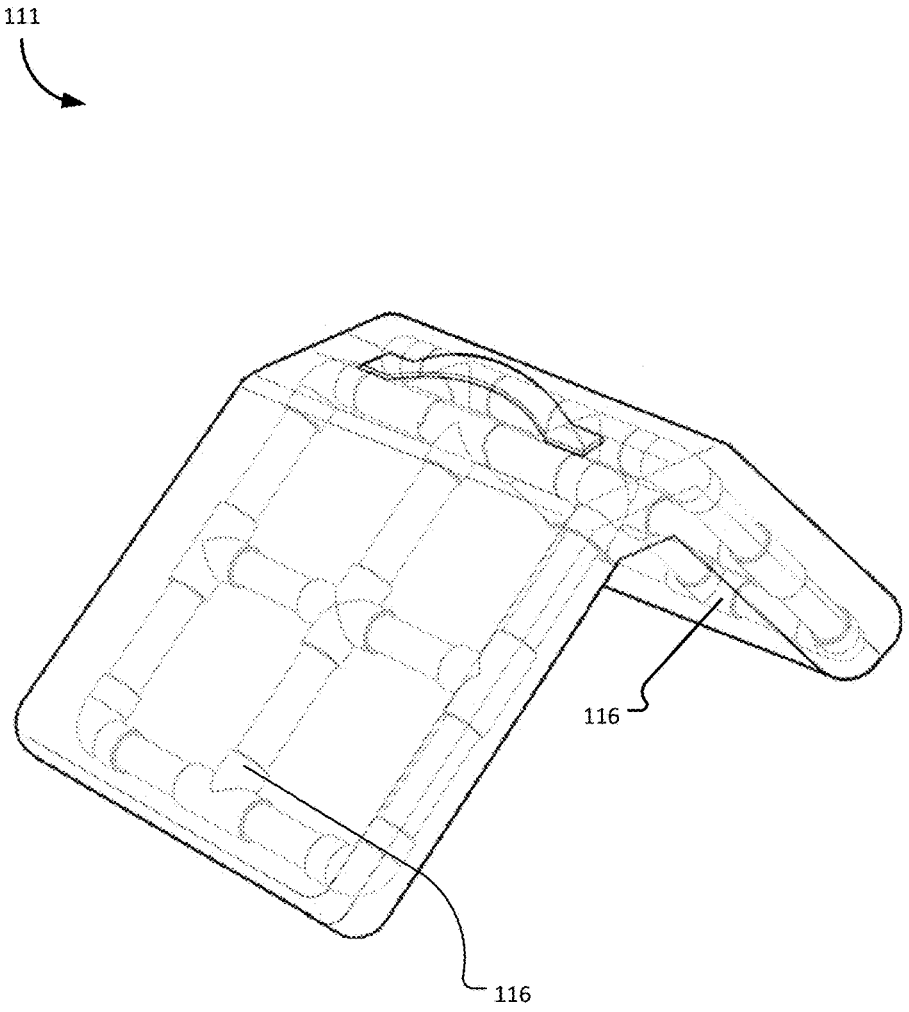
FIG. 3 illustrates an example nursing aid and child protection system showing the inner frame.

FIG. 3 illustrates an example nursing aid and child protection system 100 showing the inner frame 116. In the illustrated example, the nursing aid and child protection system 100 includes two inner frames 116 being pivotally connected. Specifically, the illustrated nursing aid and child protection system 100 includes two inner frames 116 comprising a series of structural members. In one example embodiment, the structural members may be constructed from dowel rods. In another example embodiment, the structural members may be constructed from PVC pipe and connectors (e.g., elbow joints, cross joints, t-joints). It should also be recognized that the two inner frames 116 may be made of other types of rigid support material, including a flat panel, plastic, metal, fibrous materials, weaves, and other suitable materials. In the illustrated example, the inner frames 116 are each covered by cushions 122.

The cushions 122 may be operably connected to the frames 166 in various ways. In some aspects, the cushions 122 are held in place with straps looped around the structural member of the frames 116 and held in place with buttons, ties, snaps, or hook and loop fasteners (e.g., Velrco®), while in other aspects the cushions 122 are held in place by a fabric cover that encompasses the nursing aid and child protection system 100. In various aspects, the outer faces of the front portion 108, the rear portion 110, and the top portion 106 on which mother may transfer her weight are covered with cushions 122, the inner faces that define the inner cavity 118 when in the expanded position are covered with cushions 122, or both the inner and outer faces are covered with cushions 122. The cushions 122 may also include a removable slipcover or cushions 122 that are washable. As will be appreciated, cushions 122 may vary in thickness, such that cushions 122 on the outer faces are thicker than cushions on the inner faces, or that the thickness of the cushions 122 tapers from thicker to thinner from the point of attachment of the portions to the feet of the front portion 108 and the rear portion 110.

Figure 4:
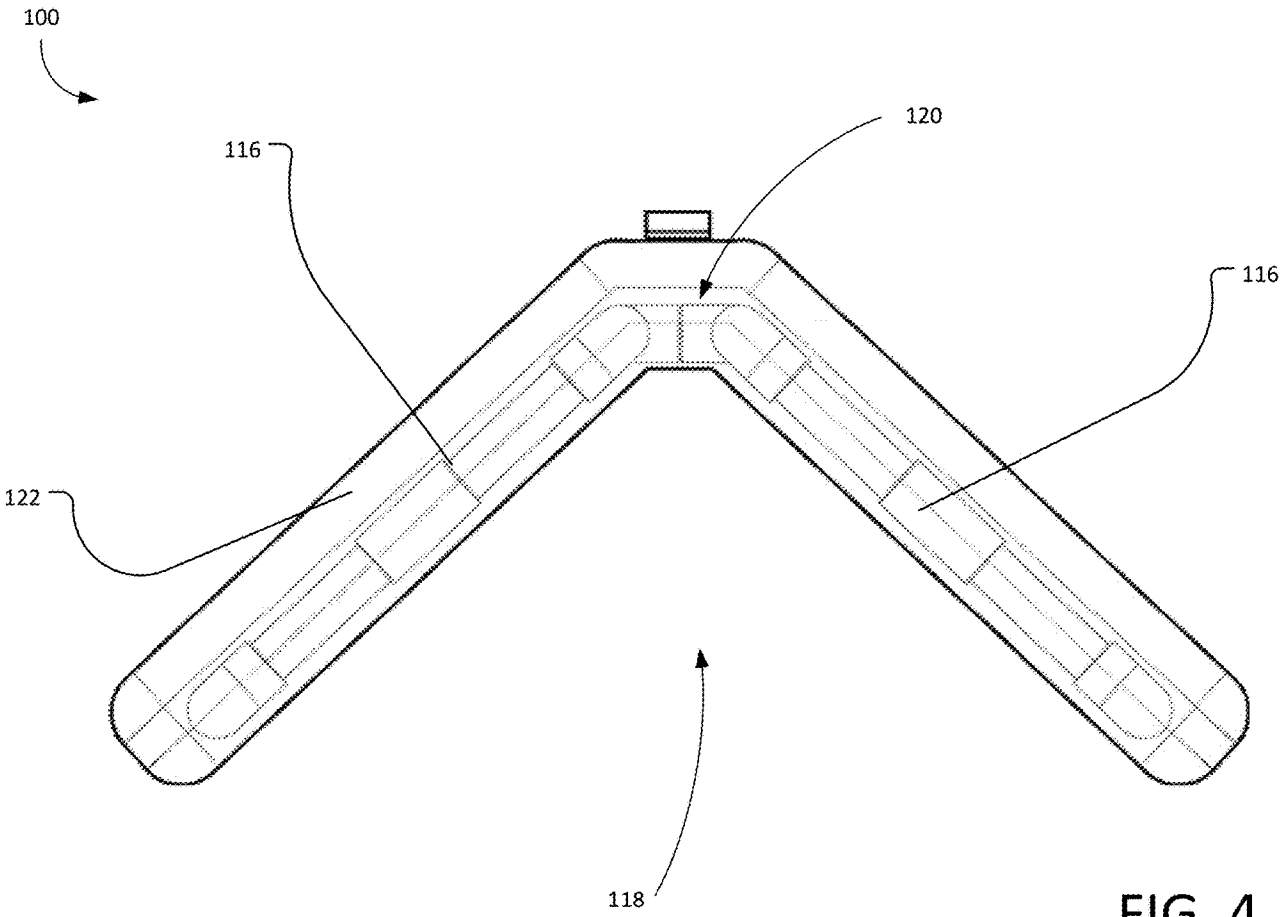
FIG. 4 illustrates an example end view of the nursing aid and child protection system showing the inner frame in an expanded position.

FIG. 4 illustrates an example end view of the nursing aid and child protection system 100 showing the inner frame 116 in an expanded position. When in the expanded position, the nursing aid and child protection system 100 provides an inner cavity 118 that is configured to receive a child 104. The inner faces of the front portion 108, the rear portion 110, and the top portion 106 define the inner cavity 118, and as a child 104 is typically nursed for twelve to twenty-four months, the inner cavity 118 is dimensioned for receiving a child from newborn to several years old.

As discussed above with respect to FIG. 3, the nursing aid and child protection system 100 includes inner frames 116 pivotally connected by one or more hinges 120. When the nursing aid and child protection system 100 is in the expanded position, the inner frames 116 are connected in a configuration for supporting the weight of a person. For example, in the illustrated example, the inner frames 116 are connected at roughly 90 degrees to one another. The top portion 106 holds the front portion 108 and the rear portion 110 substantially perpendicular to each other when in the expanded position to provide a stable base on which the mother 102 may transfer all or some of her weight when feeding the child 104.

As shown in more detail, the inner frames 116 of the nursing aid and child protection system 100 are each covered by cushions 122. The cushions 122 may be comprised of a resilient cushioned body which may be constructed of a fill material, such as a polyester foam filling. Other kinds of materials may be used, however, including, polybeads, cotton, wool, feathers, inflatable bladders of fluids (e.g., air, water, gel), and the like. It should also be recognized that the cushioning may be arranged to permit airflow and heat transfer.

Figure 5:
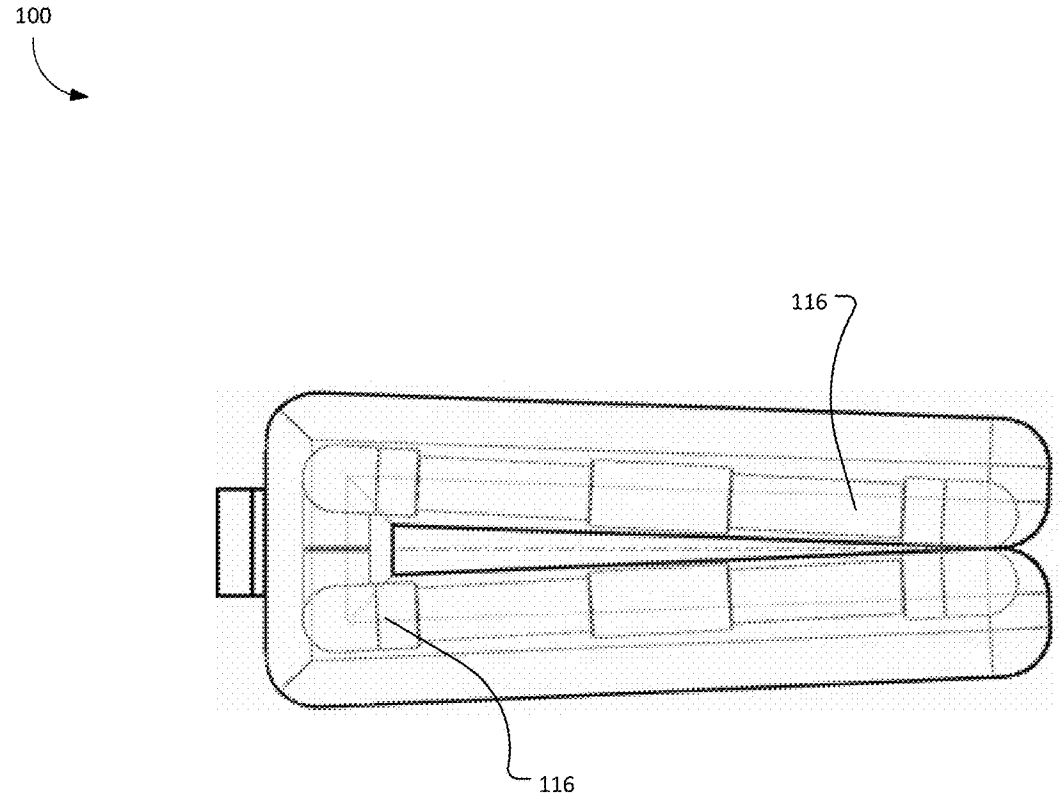
FIG. 5 illustrates an example end view of the nursing aid and child protection system showing the inner frame in the collapsed position.

FIG. 5 illustrates an example end view of the nursing aid and child protection system 100 showing the inner frame 116 in the collapsed position. As discussed above with respect to FIGS. 3 and 4, the nursing aid and child protection system 100 includes pivotally connected inner frames 116. When the nursing aid and child protection system 100 is in the closed position, the inner frames 116 are pivoted into a substantially parallel configuration. Thus, the nursing aid and child protection system 100 is arranged for storage or transportation.

Figure 6:
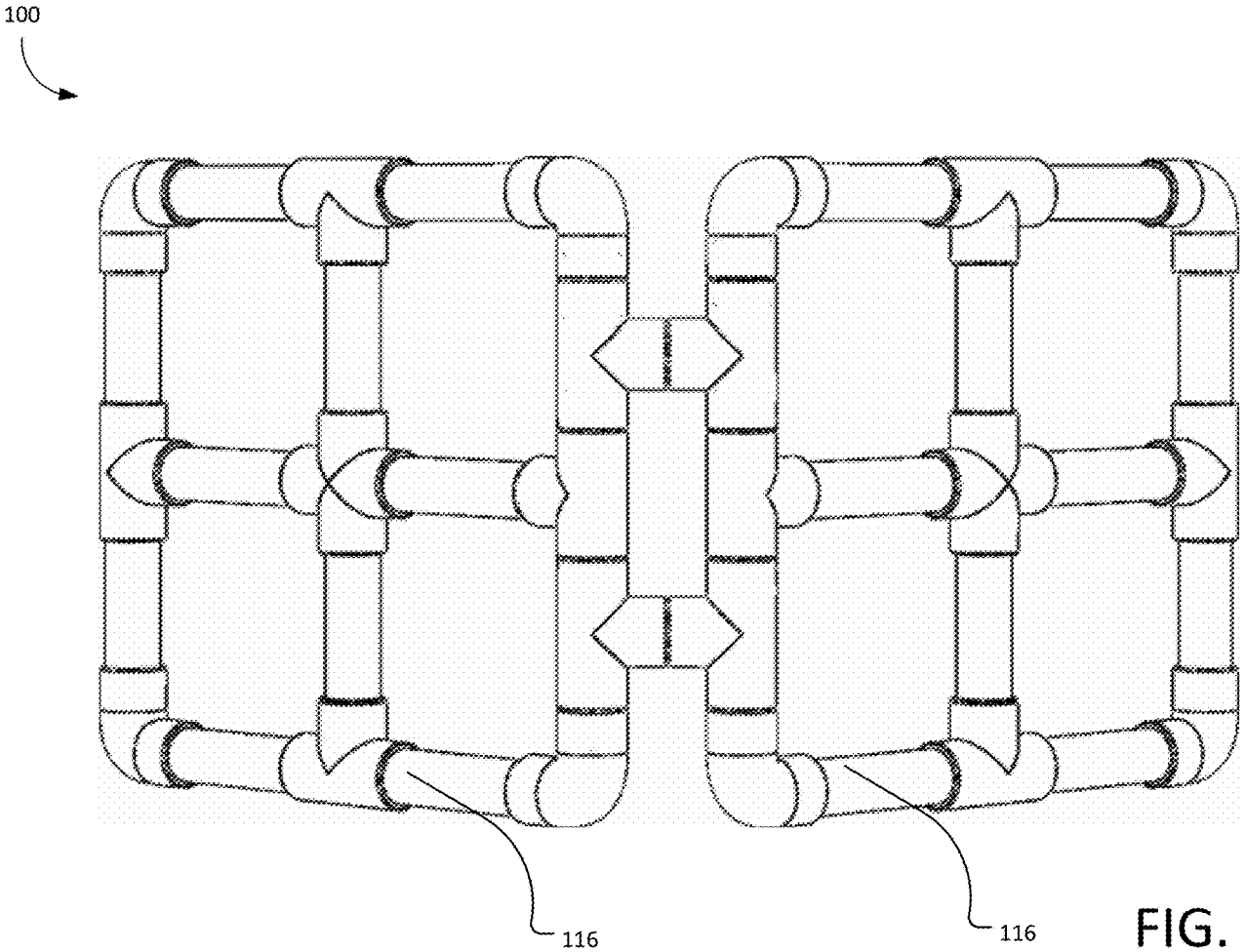
FIG. 6 illustrates an example top view of the inner frame of the nursing aid and child protection system.

FIG. 6 illustrates an example top view of the inner frame 116 of the nursing aid and child protection system 100. In the illustrated embodiment, the inner frames 116 are configured with large openings running from the inner face to the outer face of each portion to aid in airflow and heat reduction for the inner cavity 116. It should also be recognized that, the inner frames 116 may be otherwise arranged to aid in airflow and heat transfer.

Figure 7:
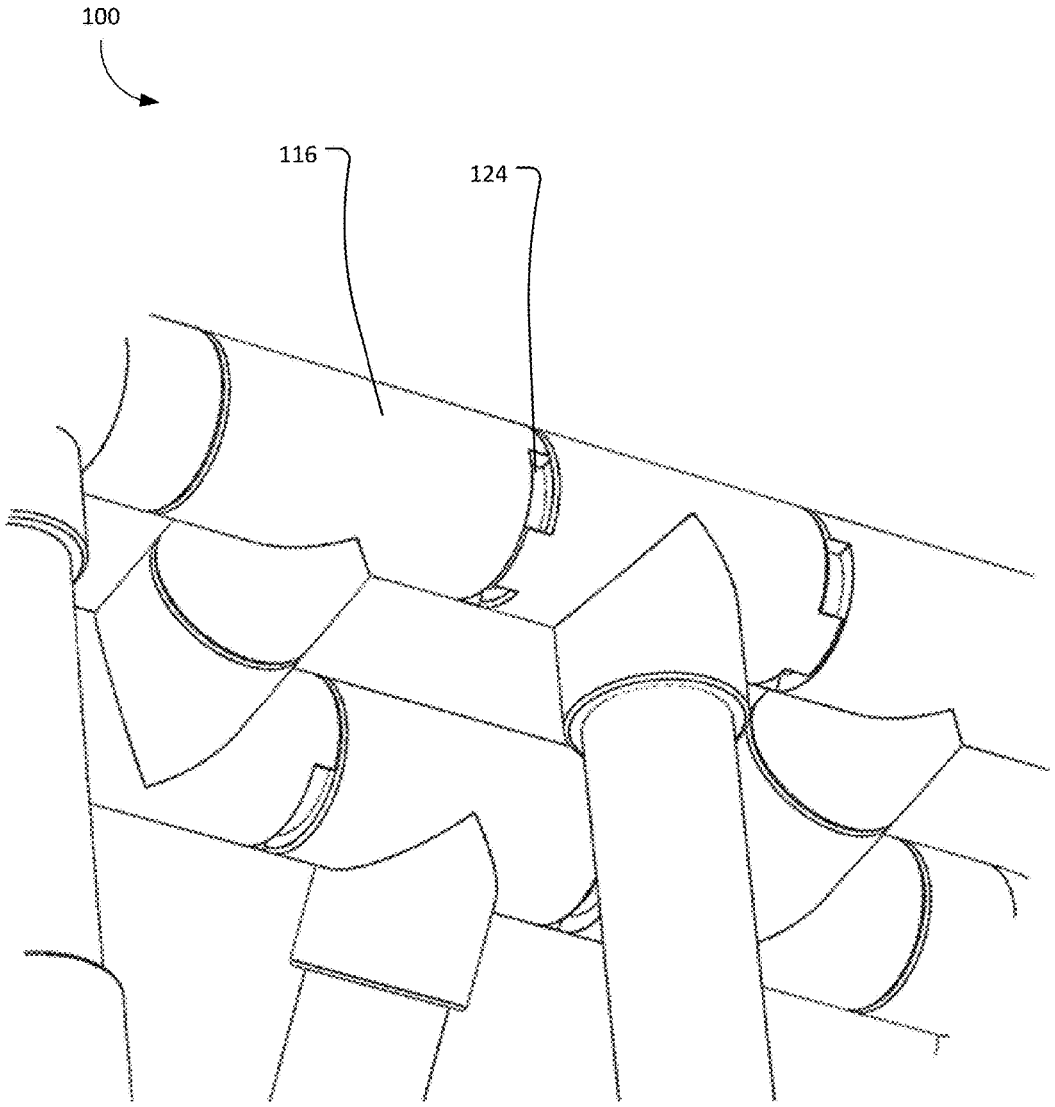
FIG. 7 illustrates an example hinged joint including a stop mechanism of the inner frame of the nursing aid and child protection system.
Figure 10:
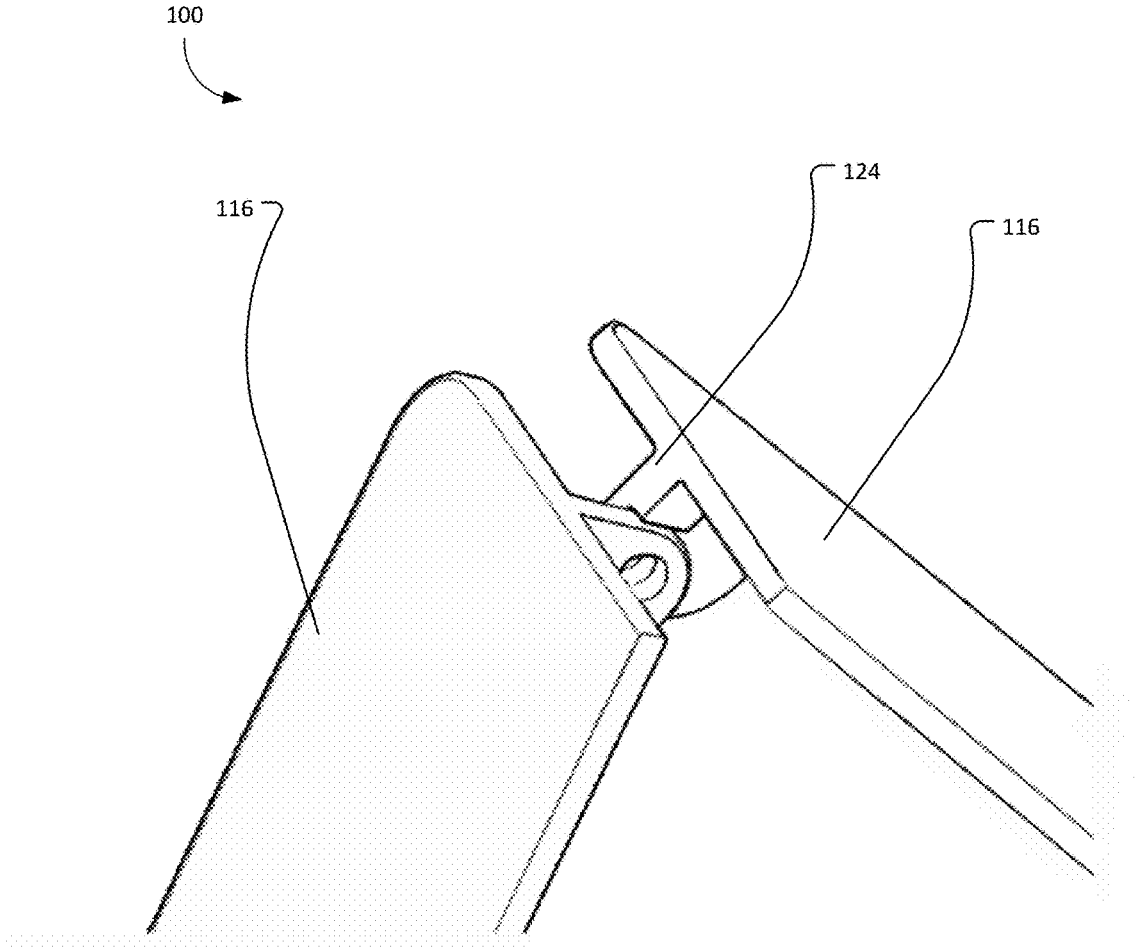
FIG. 10 illustrates an example hinged joint of the nursing aid and child protection system.

FIG. 7 illustrates an example hinged joint of the inner frame 116 of the nursing aid and child protection system 100. In the illustrated embodiment, the hinged connector 124 rotates between a first position and a second position. The hinged connectors 124 are further configured to restrict the nursing aid and child protection system 100 from opening beyond the desired arrangement. For example, the illustrated nursing aid and child protection system 100 includes a "stop" mechanism that prevents the nursing aid and child protection system 100 from collapsing onto the child 104 while the person is feeding. As discussed above, when the nursing aid and child protection system 100 is in the expanded position, the inner frames 116 are arranged in a configuration at approximately 90 degrees to one another. It should also be recognized that the inner frame 116 may otherwise be pivotally connected, such as illustrated in FIG. 10.

Figure 8:
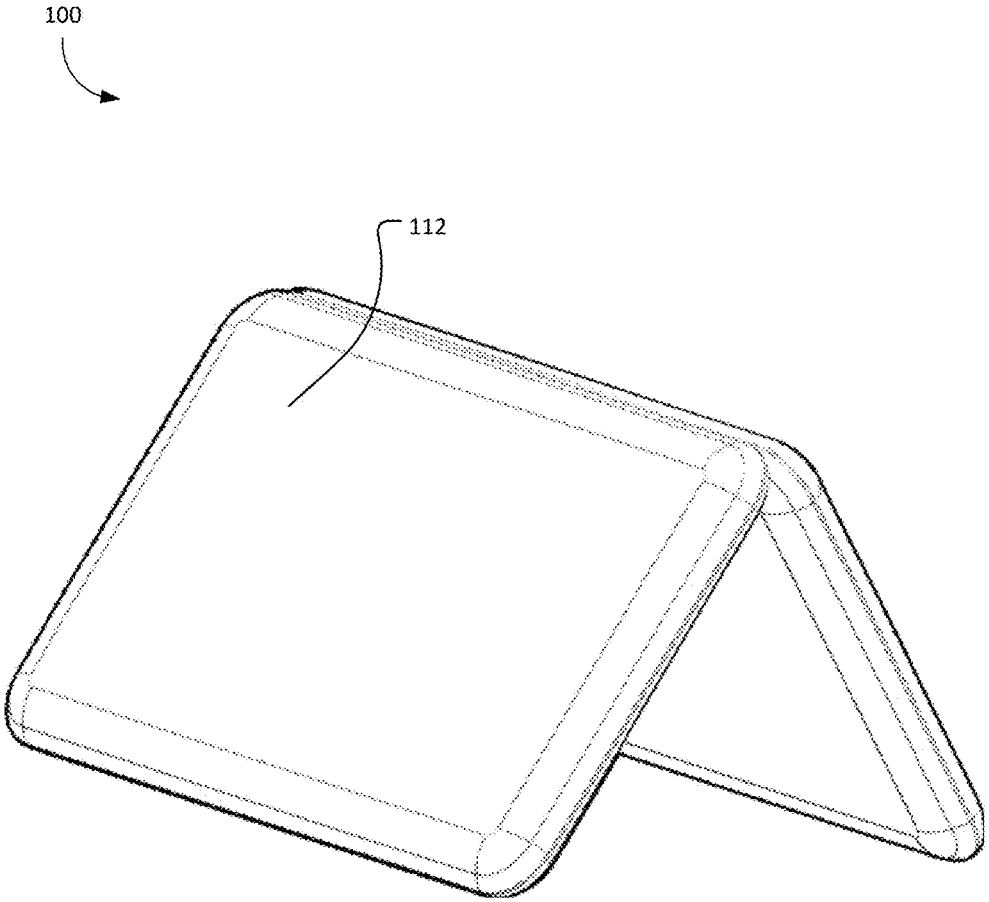
FIG. 8 illustrates an example nursing aid and child protection system.

FIG. 8 illustrates another example nursing aid and child protection system 100. Consistent with the previous discussion, the illustrated nursing aid and child protection system 100 provides a cushioned support to aid in feeding a child.

Figure 9:
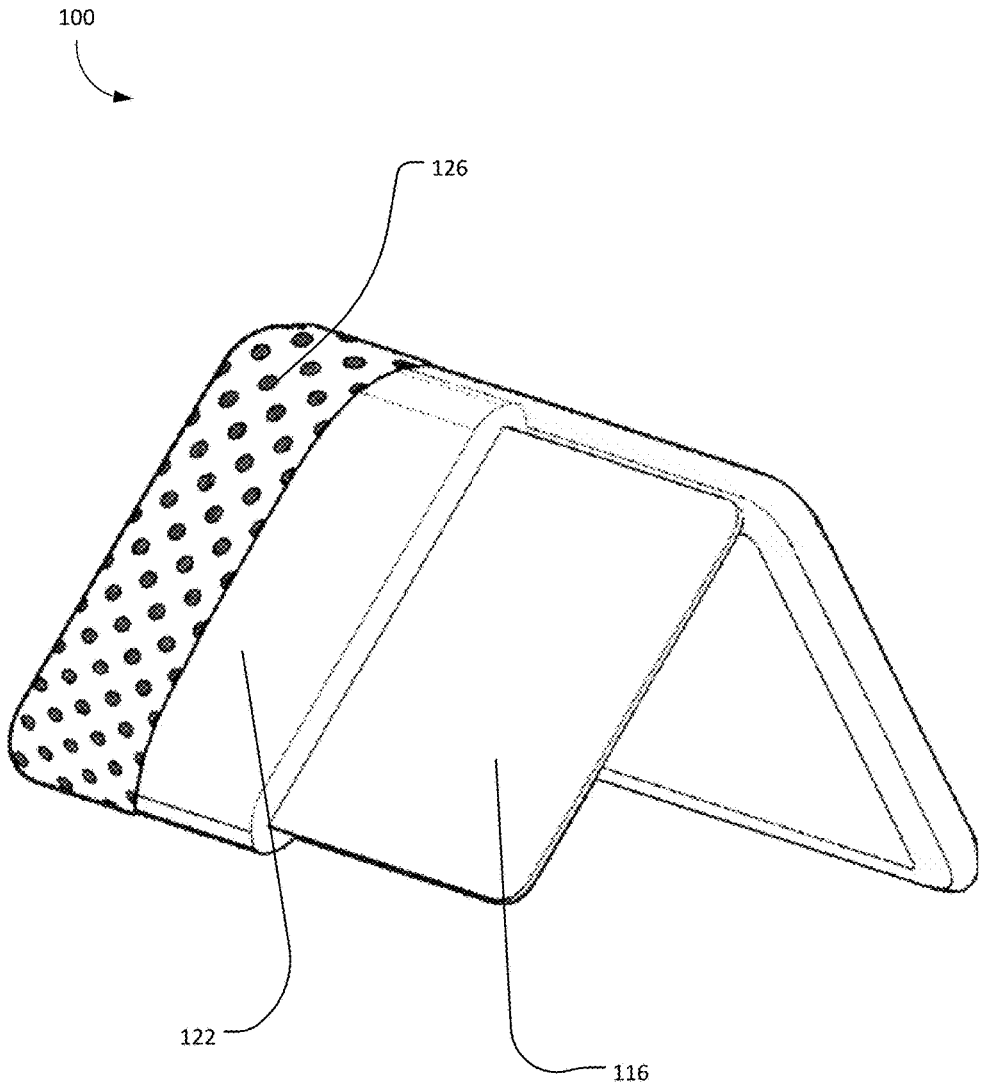
FIG. 9 illustrates an cutaway view of an example nursing aid and child protection system.

FIG. 9 illustrates a cutaway view of an example nursing aid and child protection system 100. In the illustrated embodiment, the inner frame 116 comprises an inner frame 116 comprising a plastic panel that provides rigid support for the nursing aid and child protection system 100. As previously discussed, it should also be recognized that the inner frames 116 may be made of other types of rigid support material, including piping, dowels, a solid panel, a lattice panel, plastic, metal, fibrous materials, weaves, and other suitable materials.

Further, in the illustrated example, the nursing aid and child protection system 100 includes a cushion 122 that extends around each of the inner frames 116. It should be recognized that the cushion 122 on the outward surface provides cushioning to the person feeding while cushion 122 on the inside surface provides cushioning to the child 104. The cushion 122 may be comprised of a resilient cushioning material, which may be constructed of a fill material, such as a polyester filling, that is encased within a fabric shell. Other kinds of materials may be used, however, including, polybeads, cotton, wool, feathers, inflatable bladders of fluids (e.g., air, water, gel), and the like. In one example, a seam may be placed in the fabric shell of the middle portion to prevent the migration of the fill material past the seam. In other examples, a removable slipcover 126 which fits snugly around the shape of the cushion 122 may be provided. This slipcover 126 may have one or more openings that allow the slipcover 126 to slide onto the cushion 122. Further, one or more fasteners may be used to close these openings, such as zippers, ties, buttons, snaps, hook and loop fasteners (e.g., Velcro®), and similar fasteners. Further, it should also be recognized that the cushion 122 and slipcover 126 may be removable such that the cushion 122 and slipcover 126 may be cleaned more easily.

FIG. 10 illustrates an example hinged joint 124 of the nursing aid and child protection system 100. The illustrated hinged joint 124 provides an alternate method of pivotally connecting the inner frames 116. For example, the illustrated nursing aid and child protection system 100 includes a "stop" mechanism that prevents the nursing aid and child protection system 100 from collapsing onto the child 104 while the person is feeding.

Figure 11:
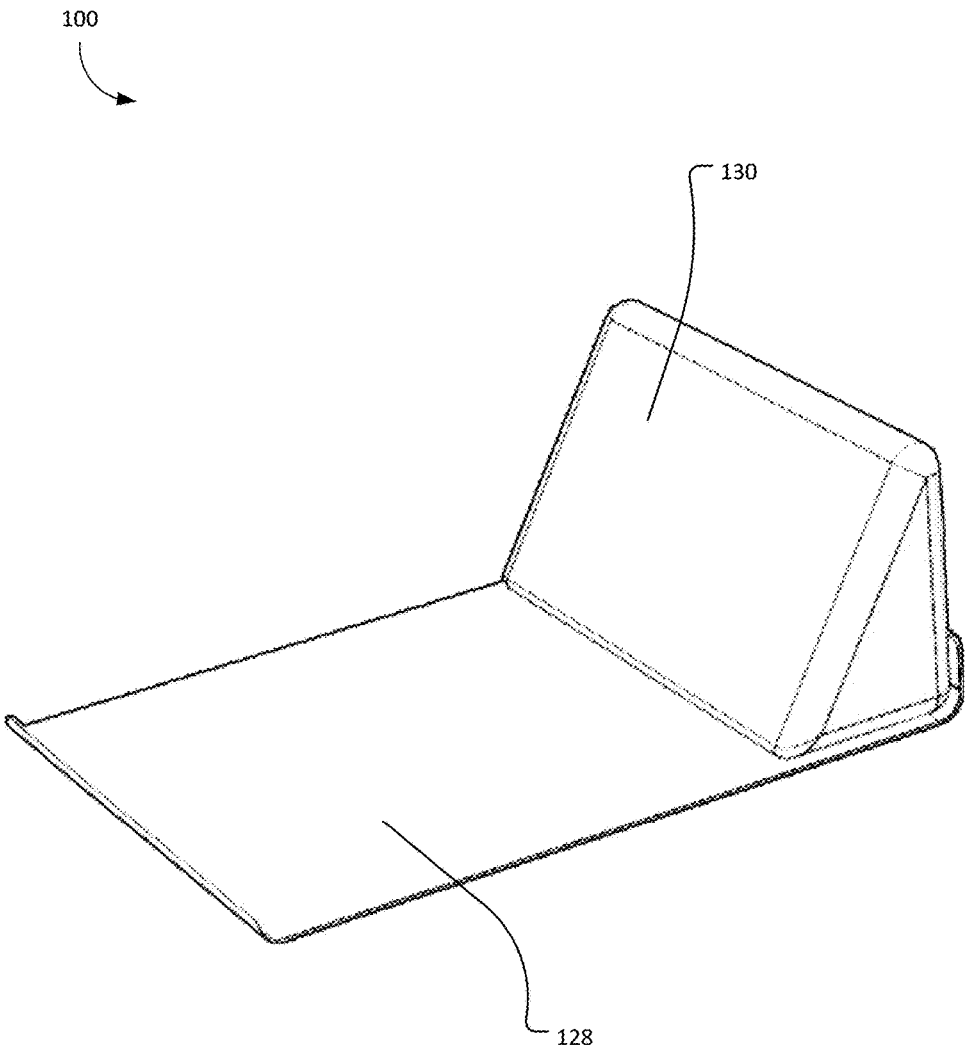
FIG. 11 illustrates an example backrest for the nursing aid and child protection system.

FIG. 11 illustrates an example backrest for the nursing aid and child protection system 100. In the illustrated embodiment, the nursing aid and child protection system 100 includes a mat 128 and back support 130. The back support 130 conforms to the person's body such that it contacts the person's upper body, giving the user a sizeable lateral surface on which to place the person's upper back and body. In the illustrated example, the pillow body of the back support 130 is configured in the shape of a scalene triangle. In such a configuration, the back support 130 may provide additional support of a user's upper and lower back. Optionally, the back support 130 may be reinforced by attachment to the mat 128. The back support 130 may be attached to the mat 128 by at least one connector, such as zippers, ties, buttons, snaps, hook and loop fasteners (e.g., Velcro), or the like.

Figure 12A:
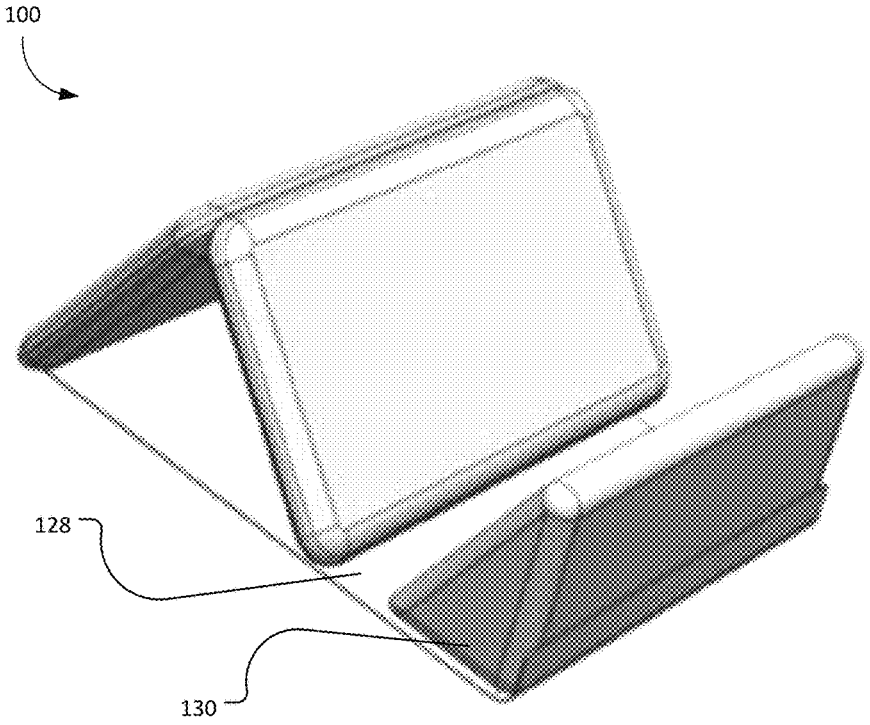
FIG. 12A illustrates a perspective view of an example backrest with the nursing aid and child protection system.
Figure 12B:
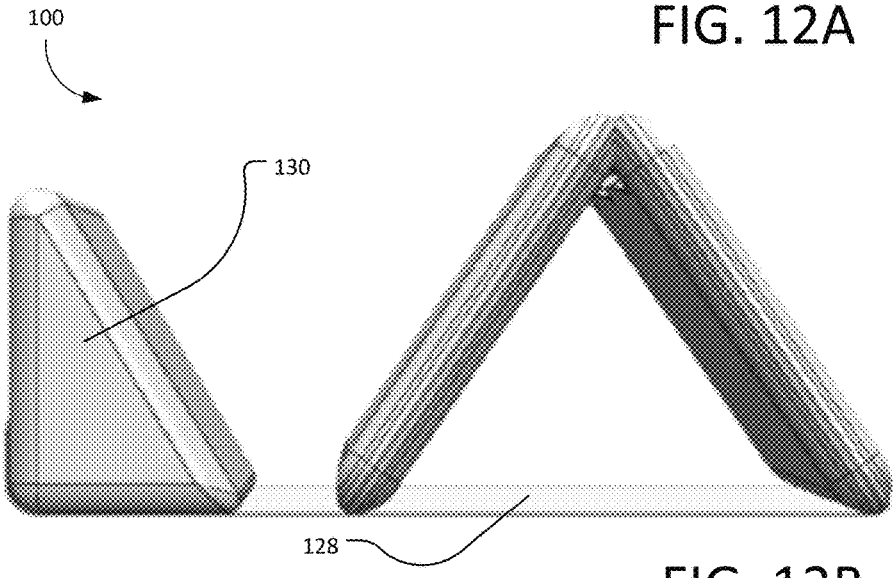
FIG. 12B illustrates a side view of an example backrest with nursing aid and child protection system.

FIGS. 12A and 12B illustrate views of an example mat 128 and back support 130 with the nursing aid and child protection system 100. As shown in FIGS. 12A and 12B, the user may be provided with additional support to position the user into engagement with the nursing aid and child protection system 100. Thus, encouraging the user's position forward without requiring the user to place excessive weight onto the nursing aid and child protection system 100.

I claim:

1. A nursing aid and child protection system comprising: a front portion including a front inner frame providing rigid support and a front cushion on at least one side of the front portion; a rear portion including a rear inner frame providing rigid support and a rear cushion on at least one side of the rear portion; and a hinged connector to pivotally connect the front portion to the rear portion, the hinged connector pivoting between a closed position and an expanded position, the hinged connector including a restrictor that prevents the front portion and the rear portion from pivoting beyond the expanded position, the expanded position defining an inner cavity between the front portion and the rear portion that is dimensioned for receiving at least a portion of a child within the inner cavity; wherein the front portion and the rear portion are substantially parallel and non-coplanar in the closed position.

2. The nursing aid and child protection system of claim 1, wherein the front inner frame and rear inner frame are constructed of rigid tubing.

3. The nursing aid and child protection system of claim 1, wherein the front inner frame and rear inner frame are constructed of rigid panel.

4. The nursing aid and child protection system of claim 1, wherein the front portion further includes a pocket dimensioned to receive a bottle.

5. The nursing aid and child protection system of claim 4, wherein the pocket comprises an elastic sleeve defining a cylindrical opening to capture the bottle.

6. The nursing aid and child protection system of claim 1, wherein the front and rear cushion each comprise a filling encased within a fabric shell, the filling comprising one of: polyester foam, polybeads, cotton, wool, feathers, and gel.

7. The nursing aid and child protection system of claim 1, wherein the front cushion is operably connected to the front inner frame by one or more straps and the rear cushion is operably connected to the rear inner frame by one or more straps.

8. The nursing aid and child protection system of claim 1, wherein a front fabric cover operably positions the front cushion over the front inner frame and a rear fabric cover operably positions the rear cushion over the rear inner frame.

9. The nursing aid and child protection system of claim 8, wherein the front cushion is attached to the front fabric cover and the rear cushion is attached to the rear fabric cover.

10. The nursing aid and child protection system of claim 1, wherein the front cushion and the rear cushion are removable.

11. The nursing aid and child protection system of claim 1, wherein the front portion and the rear portion are equally sized.

12. The nursing aid and child protection system of claim 1, wherein the front portion and the rear portion are arranged at a selected angle in the expanded position.

13. The nursing aid and child protection system of claim 12, wherein the selected angle is at 45 degrees.

14. A nursing aid and child protection system comprising:

a front inner frame providing rigid support, wherein the front inner frame defines a plurality of openings therein to allow air to flow through the front inner frame;

a rear inner frame providing rigid support, wherein the rear inner frame defines a plurality of openings therein to allow air to flow through the rear inner frame;

a top inner frame providing rigid support, the top inner frame including a front hinged connector to pivotally connect the top inner frame to the front inner frame and a rear hinged connector to pivotally connect the top inner frame to the rear inner frame, the front hinged connector and the rear hinged connector cooperatively pivoting between a closed position wherein the front inner frame and the rear inner frame are substantially parallel and non-coplanar, and an expanded position where the front inner frame and the rear inner frame are arranged at a selected angle to define an inner cavity between the front inner frame, the rear inner frame and the top inner frame, wherein the inner cavity is dimensioned to receive at least a portion of a child, wherein the front hinged connector and the rear hinged connector each include a restrictor that prevents the front inner frame and the rear inner frame from pivoting beyond the selected angle;

a front cushion that is removably attachable to the front inner frame, wherein the front cushion allows air to flow through the front cushion; and a rear cushion that is removably attachable to the rear inner frame, wherein the rear cushion allows air to flow through the rear cushion.

15. The nursing aid and child protection system of claim 14, wherein a handle is attached to the top inner frame.

16. The nursing aid and child protection system of claim 14, wherein the front inner frame and rear inner frame are constructed of rigid tubing.

17. The nursing aid and child protection system of claim 14, wherein the front inner frame and rear inner frame are constructed of rigid panel.

18. The nursing aid and child protection system of claim 14, further comprising a front fabric cover that operably positions the front cushion over the front inner frame and a rear fabric cover operably positions the rear cushion over the rear inner frame.

19. The nursing aid and child protection system of claim 18, wherein the front cushion is attached to the front fabric cover and the rear cushion is attached to the rear fabric cover.

20. A nursing aid and child protection system comprising:

a front portion including a front inner frame providing rigid support and a front cushion on at least one side of the front portion;

a rear portion including a rear inner frame providing rigid support; and a hinged connector to pivotally connect the front portion to the rear portion, the hinged connector pivoting between a closed position and an expanded position, the hinged connector including a restrictor that prevents the front portion and the rear portion from pivoting beyond the expanded position, the expanded position defining an inner cavity between the front portion and the rear portion that is dimensioned for receiving at least a portion of a child within the inner cavity, wherein the front portion and the rear portion are substantially parallel and non-coplanar in the closed position.

* * * * *